US005085179A

United States Patent [19]

Faulkner

[11] Patent Number: 5,085,179

[45] Date of Patent: Feb. 4, 1992

[54] DOUBLE POPPET VALVE APPARATUS

[75] Inventor: Henry B. Faulkner, Dover, Mass.

[73] Assignee: Ingersoll-Rand Company, Woodcliff, N.J.

[21] Appl. No.: 359,979

[22] Filed: Jun. 1, 1989

[51] Int. Cl.[5] ..... F02B 33/06

[52] U.S. Cl. ..... 123/70 R; 123/79 C; 123/543

[58] Field of Search ..... 123/79 C, 65 B, 68, 123/560, 556, 90.1, 540, 542, 543, 563, 70 R

[56] References Cited

U.S. PATENT DOCUMENTS

| | | | |
|---|---|---|---|
| 1,828,792 | 10/1931 | Tverbakk | 123/79 C |
| 3,881,459 | 5/1975 | Gaetcke | 123/188 R |
| 4,094,277 | 6/1978 | Goto et al. | 123/79 C |
| 4,284,055 | 8/1981 | Wakeman | 123/556 |
| 4,565,167 | 1/1986 | Bryant | 123/70 R |
| 4,715,326 | 12/1987 | Thring | 123/70 R |

FOREIGN PATENT DOCUMENTS

| | | | |
|---|---|---|---|
| 152847 | 10/1920 | United Kingdom | 123/79 C |
| 578468 | 6/1946 | United Kingdom | 123/79 C |

*Primary Examiner*—Willis R. Wolfe
*Assistant Examiner*—Weilun Lo
*Attorney, Agent, or Firm*—James R. Bell

[57] ABSTRACT

A double poppet valve apparatus is mounted in a combustion chamber wall. A port is formed in the wall. A first valve member is mounted in the port. A second valve member is concentrically mounted within the first valve member. One or more resilient members are provided for urging each of the valve members into respective seated positions. The first valve member is moved in a first direction and the second valve member is moved in a second direction opposite the first direction. The valve movement is effected by a cam operably engaged with a pair of rocker arms each of which is associated with one of the valve members.

12 Claims, 1 Drawing Sheet

DOUBLE POPPET VALVE APPARATUS

BACKGROUND OF THE INVENTION

This invention relates generally to internal combustion engines and more particularly to a poppet valve which will remain closed against pressure differences acting on opposite sides of the valve.

Conventional double cylinder engine concepts are limited by problems associated with the expander inlet valve. These problems are typically, 1) continuous high pressure in the inlet passage increasing valve stem leakage, 2) high pressure differences across the valve acting in opposite directions, against which the valve must remain closed, and 3) very short valve event, requiring high valve operating speed.

Injection of the fuel could take place either upstream of the expander inlet valves, or in the expander cylinders, or both. However, the injection and valve timing would be arranged such that the pressure rise due to combustion would occur almost entirely in the expander cylinders. Therefore, the expander inlet valve must use an unconventional arrangement because it must be capable of staying closed while there are substantial pressure differences acting across the valve in opposite directions Valve operating speed is a key constraint when trying to operate at high piston speed. In order to achieve high enough power density to compete with the conventional reciprocating internal combustion engine, in an engine employing reciprocating compressors and expanders, it is necessary to achieve similar high piston speed. At a volume ratio of 10, the inlet valve event length for an expander is combustion engine. The inertia loads in a reciprocating valve system are inversely proportional to the square of the length of the valve event. Therefore the inlet valve train in the expander will experience inertia loads 16 times greater than those in an engine of the same size, valve area, and piston speed. The effect will be relieved somewhat at lower volume compression ratios, but is still a major constraint.

A conventional pressure balance scheme includes a balance piston which increases the area and decreases the length of the leakage path past the valve stem which aggravates problem 2 mentioned above. Also, the balance piston increases the reciprocating mass of the valve which aggravates problem 3 mentioned above. Further, the balance piston may be more difficult to lubricate than a valve stem.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a double poppet valve apparatus comprising a combustion chamber wall defining a combustion chamber. A port is formed in the wall. A first valve member is mounted in the port. A second valve member is concentrically mounted within the first valve member. One or more resilient members are provided for urging the valve members into their seated positions. The first valve member may be moved in a first direction and the second valve member may be moved in a second direction opposite the first direction.

The foregoing and other aspects will become apparent from the following detailed description of the invention when considered in conjunction with the accompanying drawing figures. It is to be expressly understood, however that the drawing figures are not intended as a definition of the invention but are for the purpose of illustration only.

DETAILED DESCRIPTION

Figure 1:
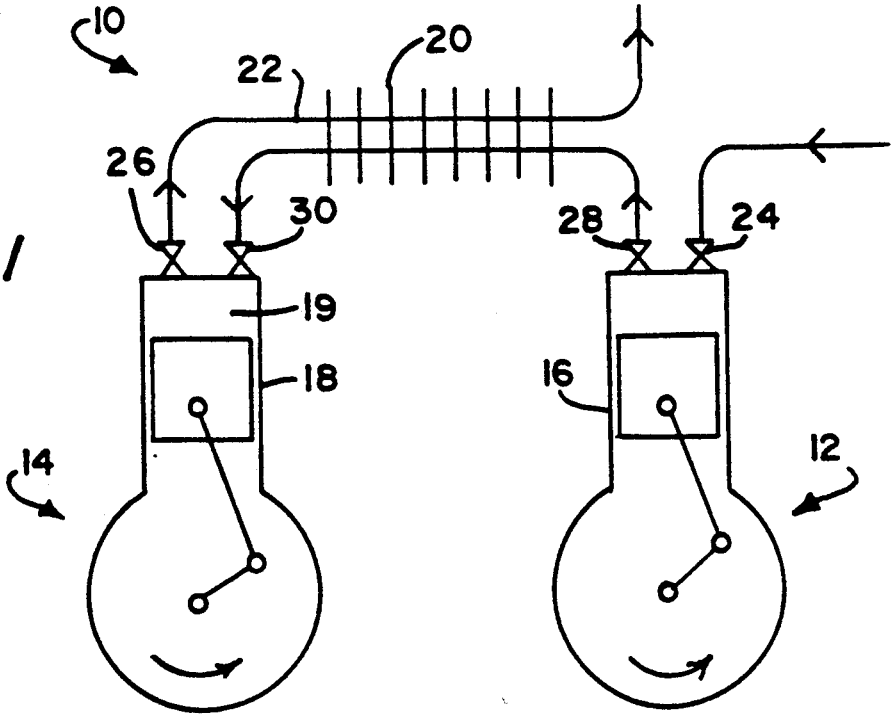
FIG. 1 is a schematic view illustrating an embodiment of a combustion engine system.

An exemplary internal combustion engine system is designated 10 in FIG. 1 and includes a compressor portion 12 and an expander portion 14. The intake and compression processes occur in one or more sets of cylinders such as that illustrated at 16. The combustion, expansion and exhaust processes occur in a corresponding set or sets of cylinders such as that illustrated at 18 and including a combustion chamber 19.

The compressor portion 12 is coupled to and driven by the expander portion 14, and the mass flow rates through the two sets must be matched Otherwise, there is no requirement that there be the same number of compressor and expander cylinders 16, 18, respectively, that they run at the same crankshaft speed, or that they be synchronized in any particular timing with respect to each other. The air passing through the engine undergoes a cycle similar to the conventional four stroke cycle, although the compressor and expander cylinders each operate on a two stroke cycle.

The system 10 has thermal recuperation. The discharge from the compressor cylinder 16 passes through one side of a heat exchanger 20 before entering the expander cylinder 18. There it receives heat from the expander exhaust stream 22, which passes through the other side of the heat exchanger 20.

A compressor intake valve 24 and expander exhaust valve 26 perform functions similar to the intake and exhaust valves of a conventional engine and could be similarly mechanized. In addition, there are separate mechanically actuated valves 28, 30 at the compressor discharge and expander inlet, respectively. Therefore the volume between these valves, 28, 30, including the heat exchanger 20, is not part of the clearance volume of either the compressor or expander cylinders 16, 18, respectively. This volume between the valves 28, 30, is sufficiently large that the pressure variation in it is small compared to the pressure variation in the individual cylinders 16, 18.

Figure 2:
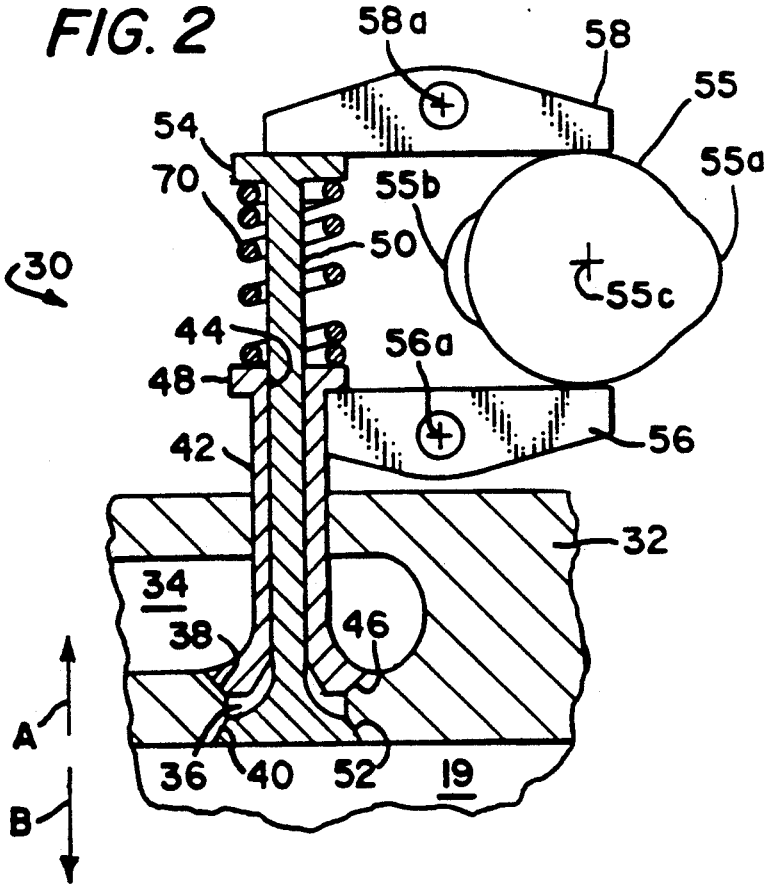
FIG. 2 is a view illustrating an embodiment of a double acting poppet valve apparatus of the present invention.

Expander inlet valve 30, FIG. 2, is preferably a double poppet valve apparatus. Combustion chamber 19 is defined by a wall 32. A port 34 is formed in wall 32. An aperture 36 is formed in wall 32 between port 34 and combustion chamber 19. A port seat 38 is formed in aperture 36 adjacent port 34 and a chamber seat 40 is formed in aperture 36 adjacent combustion chamber 19.

A first valve member 42 is mounted in port 34. First valve member 42 includes an axial bore 44 extending therethrough. A first valve seat 46 is formed on one end of first valve member 42 and a flange 48 is formed on another end opposite the one end. Valve seat 46 is configured for sealing engagement with port seat 38.

A second valve member 50 is concentrically mounted in bore 44 of first valve member 42. A second valve seat 52 is formed on one end of second valve member 50 and a flange 54 is formed on another end opposite the one end. Valve seat 52 is configured for sealing engagement with chamber seat 40. Second valve member 50 is of a greater length than first valve member 42 so that the opposite ends of second valve member 50 extend beyond the corresponding opposite ends of first valve member 42.

Means such as a cam 55 and rocker arms 56, 58, are provided for moving the first valve member 42 in a first direction designated A, and for moving the second valve member 50 in a second direction designated B, which is opposite to the direction designed A. Lobes 55*a*, 55*b* are provided on cam 55 so that upon rotation of cam 55 about a point 55*c*, rocker arm 56 is pivoted about pivot point 56*a* and rocker arm 58 is pivoted about pivot point 58*a* thus causing movement of valve members 42, 50 in opposite directions as aforesaid.

Resilient means such as a spring 70 is retained in compression between flanges 48, 54 for simultaneously urging first valve seat 46 into engagement with port seat 38, and second valve seat 52 into engagement with chamber seat 40.

As illustrated in FIG. 2, it is apparent that the first and second valve seats 46, 52 and the port and chamber seats 38, 40, respectively, are of a construction sufficient so that first valve seat 46 is urged against port seat 38 in response to pressure in port 34 being greater than pressure in combustion chamber 19, and so that second valve seat 52 is urged against chamber seat 40 in response to pressure in chamber 19 being greater than pressure in port 34.

The double poppet valve addresses the limitations associated with pressure balancing as discussed above. The leakage path is larger than that of a conventional valve, but has less area and more length than that of a pressure balanced valve. The valve tends to remain closed tightly against pressure differences in either direction. The individual reciprocating parts have less mass than that of a pressure balanced valve.

In addition, the separate moving parts of the double poppet valve make it possible to lengthen the valve event for each part while keeping the effective valve event short. This reduces the operating speed for each valve part. One part of the valve is opened and closed before the other, but the effective valve event is only the overlapping time when both valves are open.

While this invention has been illustrated and described in accordance with a preferred embodiment, it is recognized that variations and changes may be made therein without departing from the invention as set forth in the claims.

What is claimed:

1. A combustion engine system, comprising:

a compressor portion;

an expander portion operably connected with the compressor portion, the expander portion including a combustion chamber wall defining a combustion chamber;

a port formed in the wall;

a first valve member mounted in the port;

a second valve member concentrically mounted within the first valve member;

resilient means engaged between the first and second valve members for urging each of the members into a respective seated position; and means for moving the first valve member in a first direction out of its seated position and for moving the second valve member in a second direction, out of its seated position, opposite the first direction.

2. The system as defined in claim 1, wherein an aperture is formed in the wall between the port and the combustion chamber.

3. The system as defined in claim 2, wherein the aperture has a port seat formed therein adjacent the port and a chamber seat formed therein adjacent the combustion chamber.

4. The system as defined in claim 3, wherein the first and second valve members have first and second valve seats, respectively.

5. The system as defined in claim 4, wherein the resilient means urges the first valve seat into engagement with the port seat and simultaneously urges the second valve seat into engagement with the chamber seat.

6. The systems as defined in claim 4, wherein the first and second valve seats and the port and chamber seats, respectively, are of a construction sufficient so that the first valve seat is urged against the port seat in response to pressure in the port being greater than pressure in the combustion chamber, and so that the second valve seat is urged against the chamber seat in response to pressure in the combustion chamber being greater than pressure in the port.

7. The system as defined in claim 1, wherein the first and second valve members include first and second flanges, respectively, and the resilient means is compressed between the first and second flanges.

8. The system as defined in claim 1, wherein the means for moving includes a rotatable member engaged with first and second pivotable rocker arms, said first and second rocker arms respectively engaged with said first and second valve members.

9. The system as defined in claim 8, wherein the rotatable member is a cam.

10. The system as defined in claim 9, wherein said cam includes lobes for engagement with said rocker arms.

11. The system as defined in claim 1, including:

means for providing thermal recuperation.

12. The system as defined in claim 11, wherein the means for providing thermal recuperation includes a heat exchanger interconnected between the compressor and expander portions.

* * * * *